United States Patent [19]

Dornier et al.

[11] Patent Number: 4,655,263

[45] Date of Patent: Apr. 7, 1987

[54] APPARATUS FOR PRESENTING WEFT THREADS TO THE CLAMPS OF GRIPPER RODS IN SHUTTLELESS LOOMS

[75] Inventors: Peter Dornier, Lindau; Valentin Krumm, Hergensweiler, both of Fed. Rep. of Germany

[73] Assignee: Lindauer Dornier Gesellschaft mbH, Lindau, Fed. Rep. of Germany

[21] Appl. No.: 842,635

[22] Filed: Mar. 21, 1986

[30] Foreign Application Priority Data

Apr. 4, 1985 [DE] Fed. Rep. of Germany ..... 3512303

[51] Int. Cl.[4] ..... D03D 47/18

[52] U.S. Cl. ..... 139/446; 139/450

[58] Field of Search ..... 139/429, 443, 444, 445, 139/446, 449, 450

[56] References Cited

U.S. PATENT DOCUMENTS 3,665,975 5/1972 Kokkinis ..... 139/448

4,143,684 3/1979 Lindenmueller et al. .

4,553,571 11/1985 Gehring et al. ..... 139/446

*Primary Examiner*—Henry S. Jaudon

*Attorney, Agent, or Firm*—W. G. Fasse; D. H. Kane, Jr.

[57] ABSTRACT

A shuttleless loom is equipped with a displacement device for the control member or rail of the clamping device of the gripper, whereby the control rail can be displaced in parallel to the thread inserting motion of the gripper. This displacement of the control rail permits the proper presentation and transfer of the weft threads into the clamping device of the gripper even if the weft thread fan contains a substantial number of weft threads. This control rail displacement in the direction of the thread insertion into the loom shed takes place at each picking or inserting movement of the gripper and is substantially synchronous with the gripper motion after a thread transfer. When the number of threads in the thread fan is relatively small, the displacement device can be switched off.

7 Claims, 5 Drawing Figures

APPARATUS FOR PRESENTING WEFT THREADS TO THE CLAMPS OF GRIPPER RODS IN SHUTTLELESS LOOMS

FIELD OF THE INVENTION

The invention relates to an apparatus for presenting weft or filling threads to the clamps of gripper rods in shuttleless weaving machines or looms. The picking motion or weft thread insertion is performed in shuttleless looms by the movement of the gripper rods into and out of the loom shed. The grippers of these rods are equipped with clamping devices for holding the weft or filling thread. These clamping devices are positively operated by control members which in turn are responsive to the sensing of an excentric cam by a rocking lever. The control members may, for example, be control rails. In such a loom the clamping devices take over the weft thread outside of the loom shed as presented by movable thread guides of a thread presenting mechanism.

DESCRIPTION OF THE PRIOR ART

As mentioned, the picking grippers of looms of the type just described are equipped with clamping devices for gripping the filling or weft threads to be inserted into the shed. The gripping takes place outside the shed and the clamping devices must hold the thread during the insertion and transfer this thread from the clamping device of one gripper to the clamping device of the other gripper which pulls the thread completely through the shed. The thread presenting mechanism selects the weft thread next to be inserted from a plurality of filling or weft threads for presenting the selected thread to the clamping device of the inserting gripper rod. The thread presenting mechanism is equipped for this purpose with a number of needles having eyes for guiding weft threads coming from the respective supply bobbins providing, for example, weft threads of different colors. The threads coming from the supply reels or bobbins are guided through these needle eyes. These needles are moved up and down by a motion derived from the main loom drive, whereby the motion takes place in a predetermined rhythm. The needle eyes bring the threads out of a rest position into such a position that the forwardly moving insertion or picking gripper can seize the respective thread. Such a loom is, for example, known from U.S. Pat. No. 4,143,684.

In an apparatus of this type a fan of threads is formed in practice by the arrangement of, for example, eight thread presenting needles. This fan extends from the interlacing or binding point at the webbing being formed past the scissors to the eyes of the thread presenting needles. Each thread in the thread fan has a different path and also a different length. Therefore, the different, presented weft threads are picked up by the gripper on its forward motion at different locations, whereby each of the thread ends between the gripper and the end cut by the scissors also has a different length from thread to thread. These thread ends of different lengths not only impair the appearance or look of the selvage being formed, but they also increase the waste. The selvage appearance should be improved and waste should be avoided.

The control of the clamping devices of the grippers, that is, the opening and closing of the clamping devices at the time of the thread transfer outside the loom shed is accomplished by control members moving up and down. Usually these control members are rails which are controlled by rocker levers pressing the respective rail from above against an actuating lever of the clamping device, whereby the actuating lever is pressed downwardly. The rocker levers are journalled to a fixed point in the machine frame. Generally, this control arrangement is such that the control rail remains pressed down even at a point of time when the respective gripper already has started its forward motion for the thread insertion into the shed. The clamping device slides under the control rail and closes only when the actuating lever clears the control rail. In this manner it is possible to make sure that the clamping device for the weft thread closes only when, during the forward motion of the gripper, the outermost thread of the fan has also entered between the opened clamping jaws of the clamping device. For this purpose the control rail has such a length that all threads of the entire fan are securely gripped. More specifically, the control rail cooperates properly with the actuating lever of the clamping device on the one hand when the gripper is fully withdrawn outside of the thread fan, and on the other hand also when the gripper has partially advanced into the area of the outermost thread at the other side of the fan for influencing the gripper or rather, the clamping device of the gripper throughout the width of the fan.

This type of control of the clamping device, however, encounters difficulties where more than a certain number of threads form the fan of the thread presenting mechanism, for example, if it is necessary to form the fan of sixteen rather than of eight threads, whereby the width of the fan is increased. Increasing the width of the thread presenting fan is practically possible only on the side away from the loom shed. However, in this zone the arrangement of the control rail would interfere with the thread guiding between the lacing point at the webbing and the thread guide eyes of the thread presenting needles. In other words, the control rail cannot occupy space that is needed for the proper thread guiding because the control rail would prevent by its position in this zone the lowering of the respective weft thread into the path of the grippers.

OBJECTS OF THE INVENTION

In view of the foregoing it is the aim of the invention to achieve the following objects singly or in combination:

to properly present the instantaneously required weft thread to the clamping device of the gripper independently of the position of the particular thread in the fan to assure a proper gripping even if the number of threads in the thread fan is increased;

to assure the proper gripper action even if more space is required for an increased number of thread guides forming the thread fan;

to make room for widening the weft thread fan;

to provide a control mechanism for the opening and closing of the gripper clamps which is effective when wide thread fans are involved and which may be switched off when narrower weft thread fans are involved; and to control the positioning of the clamping control mechanism with due regard to the size of the fan or number of threads.

SUMMARY OF THE INVENTION

The foregoing objectives have been achieved according to the invention by a displacement mechanism which shifts the control member for the gripper clamps in parallel to the picking motion direction to an extent determined by the fan width. This feature of displacing the control member in parallel to the picking direction makes sure that there is sufficient space for widening the weft thread fan. As a result, it is possible that the individual weft threads can be brought exactly into the presenting position by their respective thread guides even if a widened thread fan is involved. The control member itself moves during the advance motion of the gripper in parallel to the gripper for a certain distance toward the loom shed and keeps the clamping device of the gripper open until even the thread closest to the loom shed can be safely introduced into the gripper clamp in which position the thread can be clamped and cut. The time of closing the clamp can be synchronized precisely with the time when the thread enters into the opened clamping device of the gripper independently of the position of the particular thread in the thread fan of the thread presenting needles so that the thread can be securely gripped or rather clamped.

The control member and the clamping device of the gripper are located on the side of the gripper path facing the tip of the thread fan. Additionally, the control member in the form of a control rail has itself a certain longitudinal dimension. These two facts make it possible that only a relatively short displacement of the control member is required for achieving the desired effect of permitting larger thread fans. Such displacement is in the order of about 2 cm.

The displacement motion of the control member can be controlled in different ways. For example, the control motion may take place in a determined rhythm in response to a drive coupling of a control excentric cam with the main drive of the loom. In an embodiment, the drive coupling may be such that the axial displacement of the control member coincides with the tilting movement of the control member. The linear displacement stroke of the control member can easily be adapted to the size of the widening of the thread fan simply by exchanging one control excentric cam by another control excentric cam of a different size.

Further, it is possible to synchronize the timing and speed of the displacement movement of the control member with the picking motion of the gripper. This may be accomplished by respectively constructing the control excentric cam. When the control of the control member is synchronized with the picking motion of the gripper, there is no relative motion between the clamping device of the gripper and the control member. As a result, wear and tear of these components is substantially reduced and the control member does not need to be constructed as a rail of predetermined length. Rather, the control member could be made shorter, for example, to form a lever or finger. The length of the displacement stroke can easily be adapted to the length of the type of control member used.

According to the invention the displacement control mechanism for the control member can be switched so that it is either effective or not effective, for example, when at certain times only a narrow weft thread fan is used. In that case, repeated displacement of the control member with each picking motion is not necessary so that the respective displacement mechanism can be switched off.

It is also contemplated according to the invention to control the displacement movement of the control member in response to a programmed control in which the displacement movement of the control member is caused by electromagnetic means. In yet another embodiment the programmed control will activate or deactivate the control excentric cam in response to the presence of special conditions or in response to the presence of special electrical signals.

The invention can be employed advantageously even when the number of threads in the fan is as such small but each thread is rather coarse, whereby the coarse threads have a tendency to stick to one another. In that case, the threads can be guided only by every other thread guide so that again a wider thread fan is formed. In such a situation the displacement movement of the control member, for example, in the form of a control rail, can be adapted to the particular requirements.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
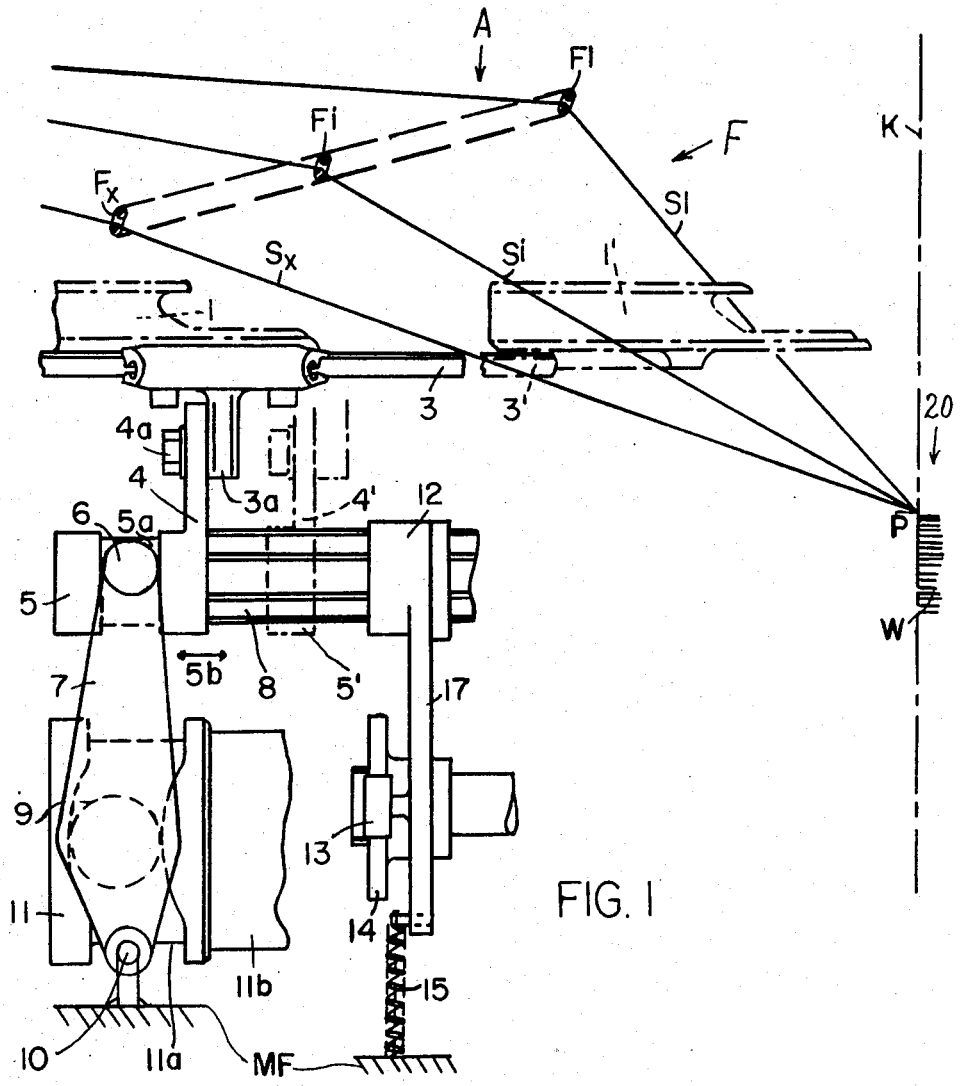
FIG. 1 is a schematic top plan view of the control member in the form of a control rail and the drive mechanism for the control rail.
Figure 5:
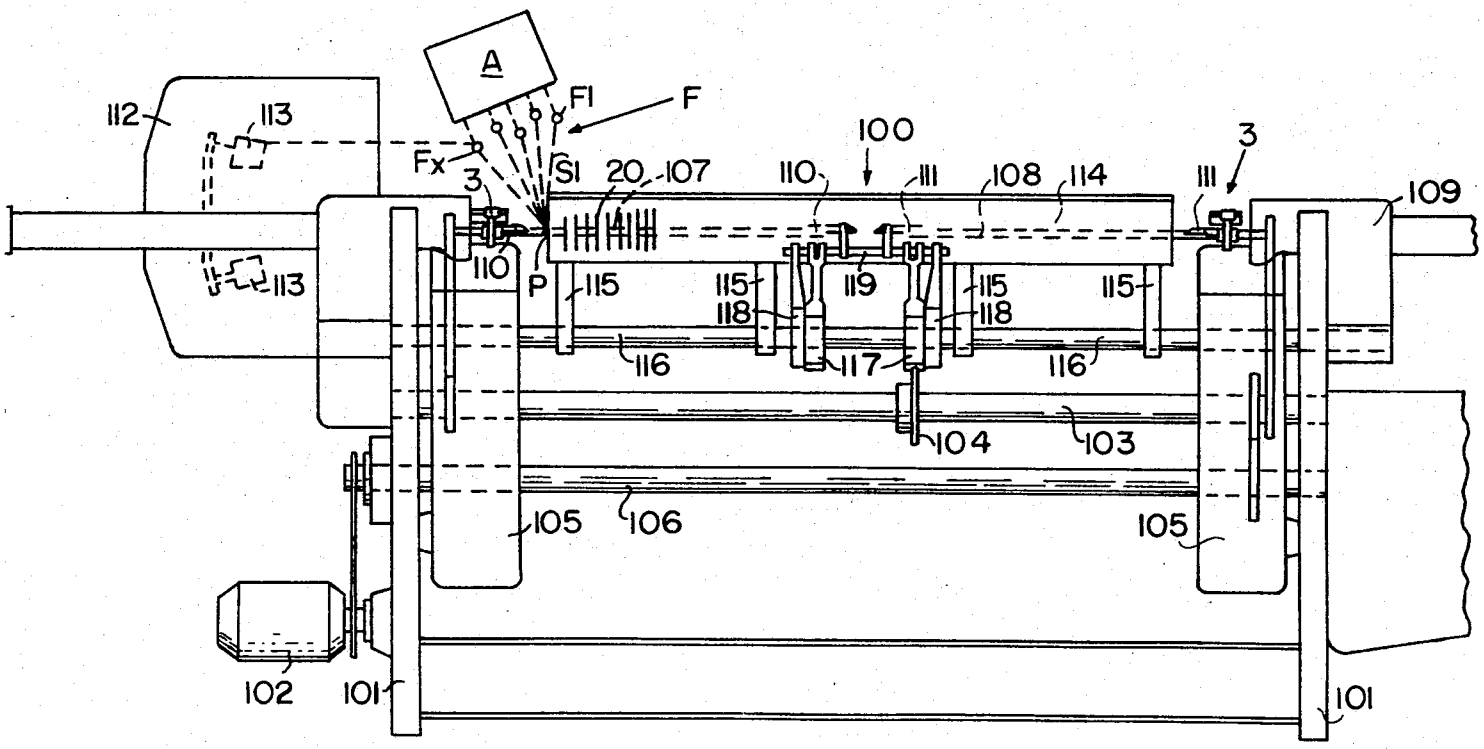
FIG. 5 is a top view of a loom as shown in FIG. 1 of U.S. Pat. No. 3,665,975 (Kokkinis for illustrating the location of the improvement of the invention in such a loom.

The top plan view of FIG. 1 shows a portion of a loom or weaving machine, whereby that portion is located to the left-hand side of the loom shed 20 formed by the warp threads K, as the viewer faces the loom 100 shown in FIG. 5. The dash-dotted line at the right-hand side of FIG. 1 shows the outer warp thread K at the selvage. The finished webbing or fabric W is shown to the right of the warp thread K. The lacing or binding point is shown at P. The weft threads S1, Si, Sx run from the lacing point P through the respective thread guides F1, Fi, and Fx of the thread guide and thread presenting mechanism A to the supply bobbins 113 shown in FIG. 5. The series F1 to Fi of the thread guide members shall represent the normal number of thread guides, for example, from one to eight. The additional thread guides up to Fx are provided for widening the thread fan F. The tip of the thread fan F is considered to be located in the lacing point P at the selvage edge of the webbing or fabric W.

Figure 2:
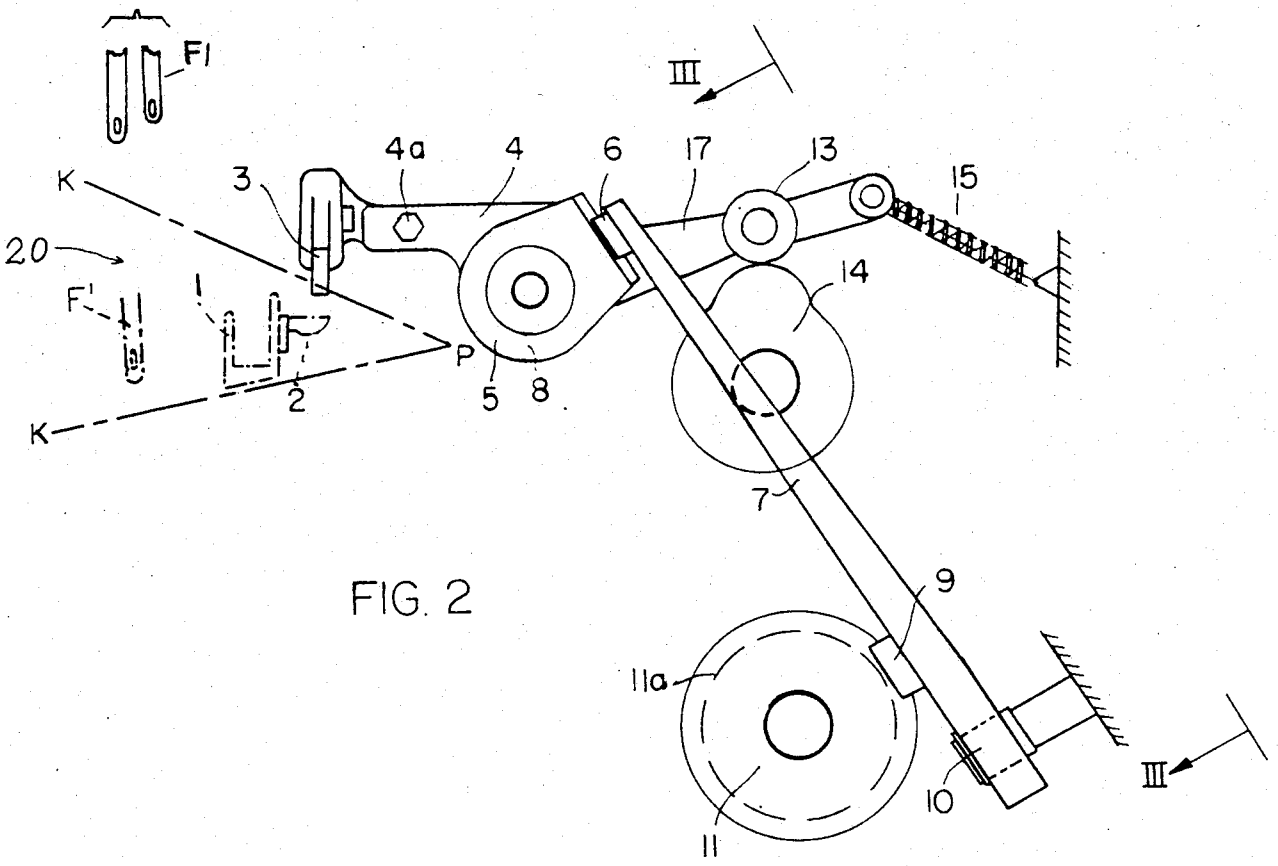
FIG. 2 is a side view of the arrangement of FIG. 1.
Figure 4:
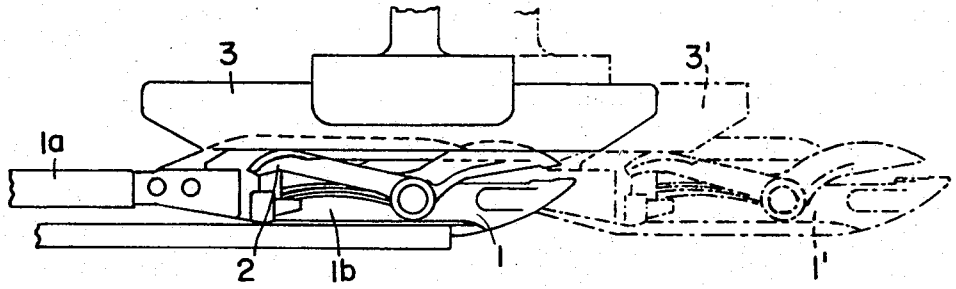
FIG. 4 shows a side view of a gripper head cooperating with a displacement control rail according to the invention.

A gripper head 1 is shown to the left and outside of the thread fan, that is, to the left of the weft thread Sx. The lever 2 of the clamping device is best seen in FIG. 4 and is operated by the control member 3 which is shown, for example, as a control rail extending in parallel to the direction of the picking motion which is horizontally in FIG. 1. The position of the clamping gripper 1 with the lever 2 for actuating its clamping device is indicated in dash-dotted lines in FIG. 2 which is a view longitudinally into the loom shed formed by the warp threads K also indicated by dash-dotted lines in FIGS. 2 and 4. As will be described in more detail below, the control rail 3 is effective on the actuating lever 2 from above for opening or closing the clamping device of the gripper 1. FIG. 2 also shows in full lines the rest position of the thread guides F1 Fi while the dash-dotted illustration shows the working position of an individual thread guide F'. The respective weft threads leading from the lacing point P or from the fabric edge are not shown in FIG. 2 so as to not obscure the clarity of the illustration. FIG. 4 further shows the gripper rod 1*a* and a spring 1*b* of the gripper 1.

FIGS. 1 and 4 show in dash-dotted lines the displaced position 3' of the control rail 3 when the latter has moved to the right toward the loom shed. The control rail 3 takes up its dash-dotted position 3' when the thread fan has a normal width, that is, it contains, for example eight threads S1 to Si. Under such a circumstance it is clear that the weft threads S1 to Si can be lowered into the path of the gripper 1 without any interference by the control rail 3 in its position 3'. Thus, insertion of the respective lowered thread into the clamping device of the advancing gripper 1 can take place without any problems. However, a lowering and presenting of threads Sx located further to the left of the thread Si, is not possible when the control rail 3 is in its dash-dotted position 3'. In order to avoid this problem the invention teaches to shift the control rail 3 into its full line position further to the left, in which position it cannot hinder the lowering and presentation of the outer weft threads Sx to the gripper 1.

The gripper 1 is shifted to the right for the weft thread insertion, whereby the respective clamping device can instantaneously seize the weft thread Sx if that thread is selected for insertion and has been presented to the gripper, However, in order to be able to also move the last weft thread S1 closest to the loom shed, into the opened clamping device of the gripper 1, it is necessary to shift the gripper 1 into its dash-dotted position 1'. During this displacement of the gripper 1 into the position 1' it is necessary to keep the clamping device of the gripper 1 in its opened position. It is also necessary to make sure that the actuating or clamping lever 2 during this movement or displacement is not separated from the control rail 3 to thereby avoid an erroneous actuation of the clamping device. In other words, it is necessary to make sure that even in the position 1' of the gripper 1 its clamping device will be positively and timely controlled. For this purpose the displacement mechanism for the control rail 3 makes sure that the control rail 3 is displaced during the gripper advance into the position 3'. This displacement mechanism for the control rail 3 will now be described. The control rail 3 has an extension 3*a* secured to a rocker lever 4 as shown at 4*a*. The rocker lever 4 in turn forms part of a coupling sleeve 5 which is axially displaceable back and forth in the direction of the arrow 5*b* along a splined shaft 8. Thus, the the coupling sleeve 5 and the rocker arm 4 can be moved from the full line position into the dash-dotted line position 5', 4', whereby the control rail 3 is also moved into its position 3'.

In the shown example embodiment the axial displacement of the coupling sleeve 5 along the splined shaft 8 is accomplished with the aid of a lever 7 which is pivoted or journalled in the journal 10 rigidly secured to the machine frame MF. The upper end of the lever 7 engages with a roller or sliding member 6, a groove 5*a* in the coupling sleeve 5. The lever 7 further carries a roller 9 engaging a groove 11*a* of a grooved excentric cam 11. The groove 11*a* has the shape shown, for example, whereby a rotation of the cam 11, the lever 7 is caused to oscillate back and forth by tilting about its pivot or journal point 10, thereby axially displacing the coupling sleeve 5 on the splined shaft 8. The displacement of the coupling sleeve 5 in turn shifts the lever 4 and thus the control rail 3. By suitably shaping the curvature of the excenter groove 11*a*, it is possible to determine the displacement speed of the control rail 3 as well as the timing for the beginning and the end of the displacement movement.

This determination in turn permits adapting the movement of the control rail 3 to the advance speeds of the gripper 1 and to synchronize the two motions with each other.

The operation of the control rail 3 for opening and closing the clamping device of the gripper 1 takes place in a manner known as such by rotating the splined shaft 8 having an extension 8*a* rotatably supported in bearings 8*b* in the frame MF. The rocker lever 4 and the control rail 3 attached thereto, performs an up and down oscillating motion for pressing from above against the operating lever 2 of the gripper head 1. The rotational movement of the splined shaft 8 is derived from an excentric cam 14 which in turn is driven by the main drive of the loom shown in FIG. 5. A coupling sleeve 12 is rigidly secured to the splined shaft 8. The coupling sleeve 12 has a lever 17 for sensing the excentric cam 14 with the aid of a sensing roller 13 rotatably secured to the lever 17. The free end of the lever 17 is connected through a reset spring 15 to a fixed point of the machine frame MF as shown. Thus, the opening and closing of the clamping device of the gripper 1 is coupled with the feed advance motion of the gripper 1.

Figure 3:
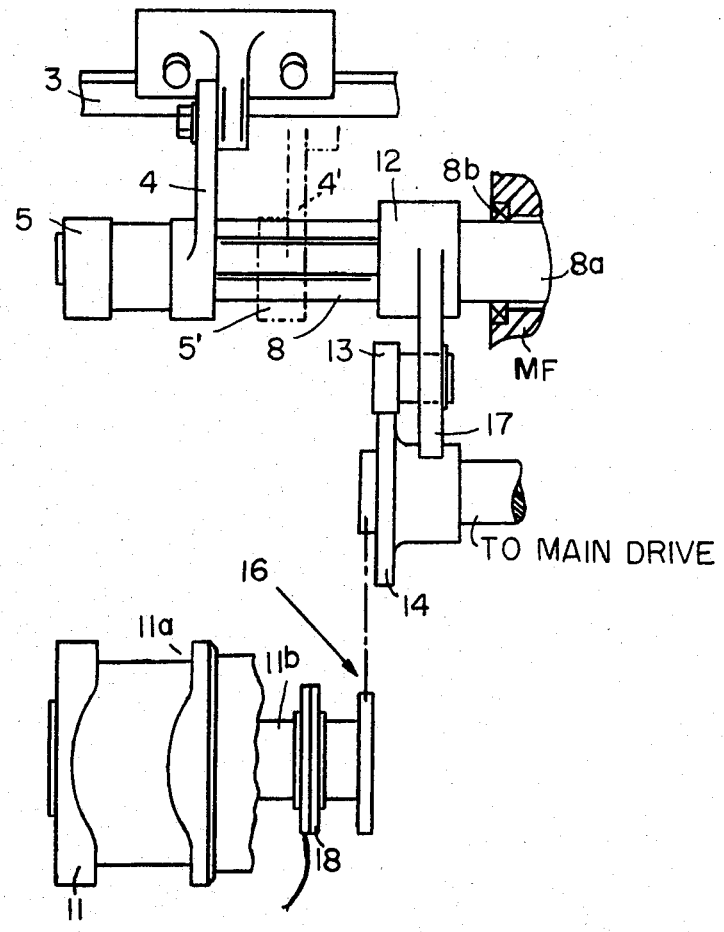
FIG. 3 is a slanted view toward the line defined by the arrow III—III in FIG. 2.

Referring to FIG. 3, the lever 7 causing the displacement movement of the sleeve 5 is not shown in FIG. 3 for simplicity's sake. Compared to FIGS. 1 and 2, however, FIG. 3 shows additionally the drive connection 16 between the excentric cam 14 for the up and down movement of the control rail 3 on the one hand, and the grooved excentric cam 11 for the axial displacement of the control rail 3 on the other hand. With the aid of these drive connections just described, the axial displacement movement of the control rail 3 can be accomplished in a simple manner and in a fixed rhythm in synchronism with the picking movements of the gripper 1.

The displacement of the control rail 3 to the left into a zone outside of the thread fan is performed for each individual thread presentation. Further, the displacement of the rail 3 to the right from its left position into its right position 3' closer to the loom shed is performed with each picking motion or thread insertion. However, when the thread fan is narrow, for example, when it contains only the threads of the series S1 to Si for presentation, then a continuously repeating displacement of the control rail 3 is not necessary and the displacement mechanism according to the invention is switched off. In other words, the groove excentric cam 11 with the sensing roller 9 and the rocking lever 7 can be decoupled or made ineffective in any other suitable way. For example, in FIG. 3 an electrically operated clutch 18 is arranged in the drive shaft 11*b* of the excentric cam 11 for coupling or decoupling the drive shaft 11*b* to the drive connection 16. When the clutch 18 is deenergized, the cam 11 is not driven and the sleeve 5 remains in its dashed position 5', thereby holding the control rail 3 in its dash-dotted line position 3'.

No problems are encountered in driving the displacement mechanism according to the invention, that is, the groove excentric cam 11 in response to a control program which determines the displacement movement of the control member or control rail 3 in accordance with a freely programmable rhythm.

FIG. 5 shows the location of the improvement of the invention in a conventional loom, for example described and shown in U.S. Pat. No. 3,665,975 (Kokkinis).

FIG. 5 is a schematic view of a loom 100 having a frame 101. Mounted at the side thereof is the drive motor 102 and all the movements are derived from his central drive. The drive shaft 103, on which the eccentric 104 is mounted, is driven by the common gear 105 via the main drive shaft 106. The gripper rods 107, 108 are moved to and fro by means of the gripper rod gear 109. The gripper rod 107 is provided at its front end with the gripper head 110 and the gripper rod 108 carries the gripper head 111. The two gripper rods with the gripper heads thereof have been shown in full lines in the retracted position thereof when they are outside of the shed and in phantom in the extended position thereof approximately in the center of the shed. The supply spool container 112 receives the weft thread supply spools 113. Positioned in the center of the machine is the comb or reed 114 which is driven by the arms 115 of the reed shaft 116 and oscillated back and forth. Secured to this reed shaft 116 are also the drive elements for the control of the gripper heads, such as the roller lever 117 and the supporting arm 118, respectively. The clamping devices or means at the gripper heads 111 and 110 are controlled in the center of the shed 20 by means of the control mechanism 119 and outside of the shed 20 by means of a control mechanism 3 of the invention. The drive elements for the control mechanism 119 are positioned on the reed shaft 116, and include the roller lever 117 and the supporting arm 118. The drive thereof is effected by means of the eccentric disc 104 as is conventional. The control mechanism 3 is driven as disclosed above.

In the case of the loom which has been shown here as one embodiment, it has been assumed that the weft thread is inserted at all times only from the left side as an individual thread. Accordingly, the left gripper head 110 may be designated as "transmitting means" and the right gripper head 111 may be designated as "receiving means". The construction of the gripper heads has been shown in further detail in FIG. 4.

Although the invention has been described with reference to specific example embodiments, it will be appreciated, that it is intended to cover all modifications and equivalents within the scope of the appended claims.

What we claim is:

1. A shuttleless loom apparatus, comprising gripper means (1), thread guide means (F) for presenting a weft thread to said gripper means (1) out of a thread fan containing a number of weft threads, said gripper means inserting the presented thread into a shed in said shuttleless loom, control means (3) for controlling the operation of said gripper means to receive and hold a thread from said thread presenting guide means, and displacement drive means for operating said control means, said displacement drive means comprising drive transmission members (5, 6, 7, 9, 11) for displacing said control means (3) in parallel to a movement direction of said gripper means (1) for adapting a control means displacement to said number of weft threads in said thread fan.

2. The loom of claim 1, wherein said displacement drive means comprise a rocker lever (4) for supporting said control means (3), a mounting sleeve (5) connected to said rocker lever (4), a tilting shaft (8) having splines therein for supporting said mounting sleeve (5) for axially shifting said mounting sleeve (5) back and forth along said tilting shaft (8), and means (7) operatively connected to said mounting sleeve (5) for moving said mounting sleeve back and forth along said splined shaft (8).

3. The loom of claim 2, wherein said moving means comprise curved cam drive means **(11, 11*a*) and drive transmitting means (6, 7, 9)** arranged for transmitting drive power from said curved cam drive means through said mounting sleeve to said control means.

4. The loom of claim 3, wherein said curved cam drive means comprise a cam with a curved groove **(11*a*)** in said cam.

5. The loom of claim 1, further comprising clutch means (18) connected to said displacement drive means for disconnecting driving power from said displacement drive means.

6. The loom of claim 1, wherein said control means comprise a control rail (3) extending in parallel to said gripper means (1).

7. The loom of claim 1, wherein said displacement drive means comprise drive control means for displacing said control means (3) in synchronism with said gripper means (1).

* * * * *